United States Patent [19]

Chakravorty

[11] Patent Number: 4,662,578

[45] Date of Patent: May 5, 1987

[54] GRAVITY ACTUATED, UNIDIRECTIONAL REGULATED TISSUE DISPENSING SYSTEM

[76] Inventor: Shyamal Chakravorty, 7360 Silver Pine Dr., Springfield, Va. 22153

[21] Appl. No.: 809,242

[22] Filed: Dec. 16, 1985

[51] Int. Cl.[4] ..... B65H 19/00; B65H 35/00; G05G 1/00; B26F 3/02

[52] U.S. Cl. ..... 242/55.53; 242/68.5; 242/110.3; 74/577 S; 192/46; 226/127; 225/16; 225/52; 312/37

[58] Field of Search ..... 242/55.3, 55.2, 55.53, 242/68.5, 72 R, 110.3, 129.7, 129.6, 130; 312/37, 38, 39; 74/577 S, 142; 192/46; 226/127, 129; 225/10, 16, 51, 52, 84, 85

[56] References Cited

U.S. PATENT DOCUMENTS

| | | | |
|---|---|---|---|
| 2,474,672 | 6/1949 | Hill | 242/129.7 X |
| 3,606,407 | 9/1971 | Pendergast | 242/68.4 X |
| 4,235,389 | 11/1980 | Ness | 242/55.2 |
| 4,406,421 | 9/1983 | Schultz et al. | 242/55.53 |

*Primary Examiner*—John M. Jillions
*Assistant Examiner*—David Werner

[57] ABSTRACT

Described is a mechanical device designed to dispense tissue paper or cloth web by gravity-actuated release gear system. The release gear system is activated by pressing a lever that is connected to the unidirectional gear release system. The gear mechanism is supported on the inside of the dispenser and has the lever extending through a side opening of the cover of the cabinet. The gear train, connected to this lever, is also connected to the axle of the towel roll through a square butt end.

2 Claims, 7 Drawing Figures

GRAVITY ACTUATED, UNIDIRECTIONAL REGULATED TISSUE DISPENSING SYSTEM

This application is related to the application, Ser. No. 06/694,273 titled Regulated Automatic Tissue And Moisture Dispensing System, filed on Jan. 24, 1985.

BACKGROUND OF THE INVENTION

Until now tissue paper or cloth towel has been dispensed through the use of force-fed towel roller system. In this type of feed system, the user has to push a lever or rotate a crank to release the towel web through a mechanism of feeder rollers pressing the web against a system of idler rollers. This necessitates the towel web to be strong and tenacious so as to withstand the pressure of the rollers. Dispensers of this type are found in U.S Pat. No. 3,084,664, U.S. Pat. No. 2,989,024, U.S. Pat. No. 3,843,218 and U.S. Pat. No. 4,406,421. The last two patents employ complex gear and clutch mechanisms which require relatively difficult and expensive construction.

Therefore, it is an objective of the present invention to provide a simple, inexpensive towel dispensive system that will easily release towel web by the push of a lever mounted on the side of the cabinet or housing containing the towel roll.

The gear system described herein takes advantage of gravity thereby considerably reducing the human effort needed in the releasing the towel web. Also, since the towel web does not run through feeder rollers pressing against the idler rollers, it need not be made of strong, tenacious materials. The towel can be tissue paper or perforated gauge or soft cloth.

SUMMARY OF THE INVENTION

The invention relates to a regulated towel web dispensing sytem specifically designed for applications in the facilities where tissue paper or soft towel cloth is used for cleansing and drying purposes, such as, in the residential kitchens, in the bathrooms and in the medical facilities.

The unidirectional, gear mechanism translates the actuating lever axle motion into rotary motion of the roller carrying the towel roll. The web is dispensed without the application of any oneway clutch mechanism or feeder rollers.

The web, once unrolled, is caught in an opening or slit of the cabinet by a lip which is also controlled by the gear described herein. In this grasped position, the towel web is available for easy tearing off from the main body of the towel roll inside the cabinet.

This design minimizes the complexity and the expense of prior art drive mechanisms. The gear itself acts as its own clutch system providing unidirectional motion and towel web release.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the calims appended hereto.

Figure 1:
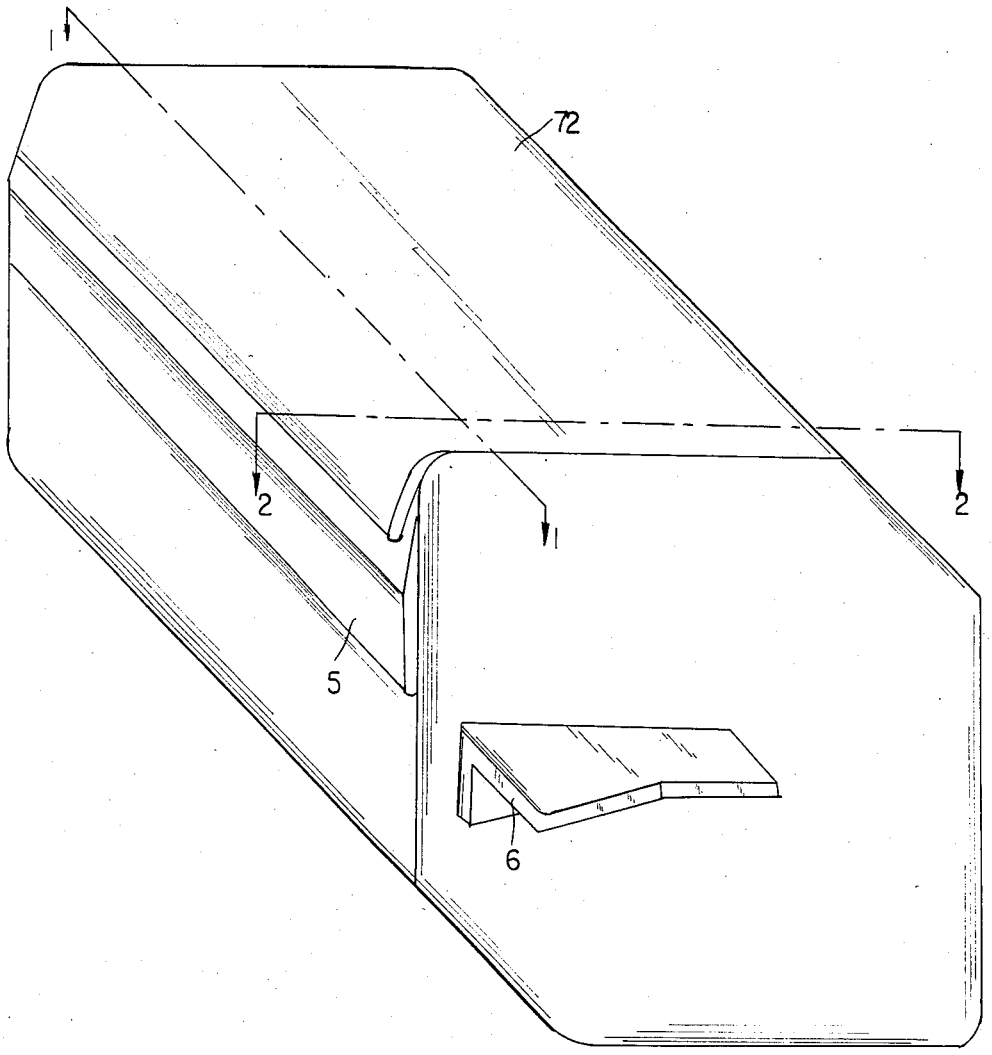
FIG. 1 is an isometric view of the roll towel dispenser embodying the roller axle, the gear system and the dispensing lever.
Figure 2:
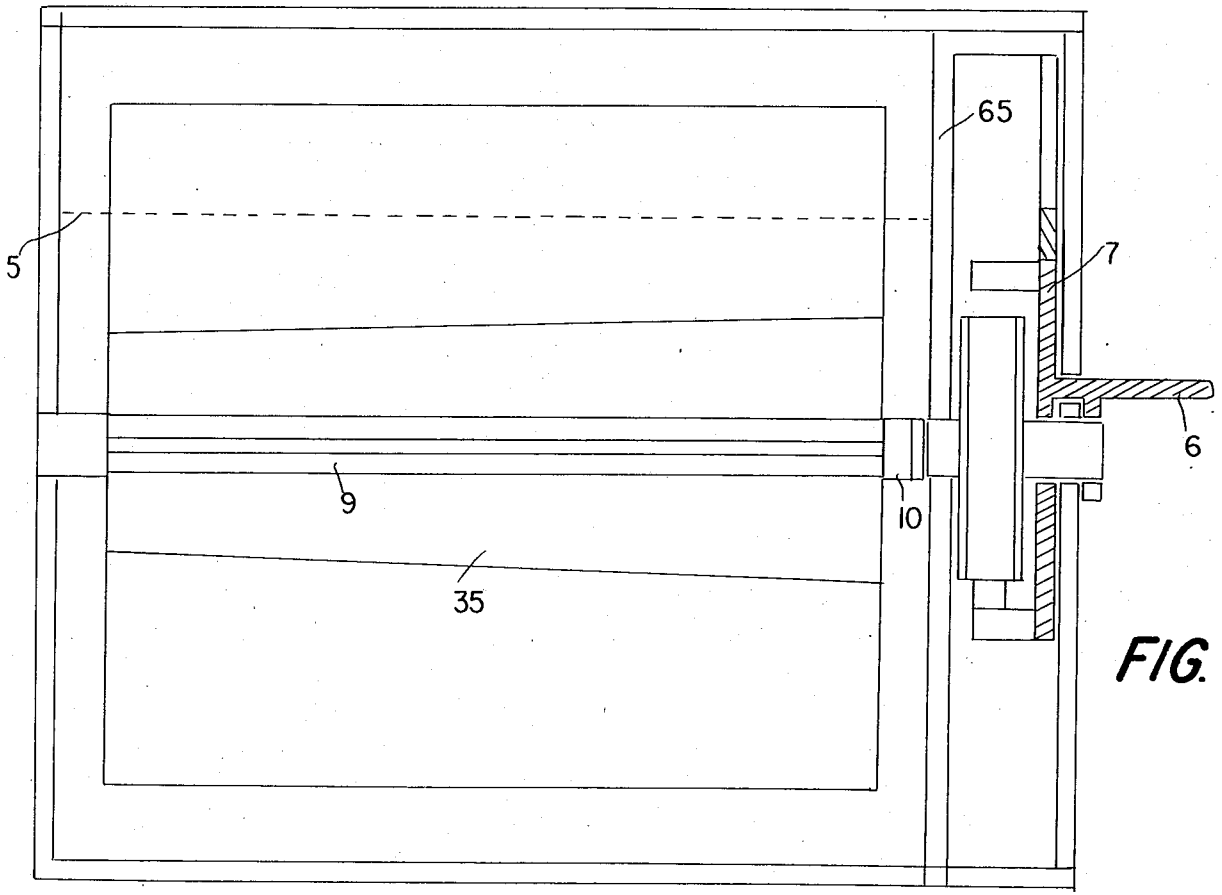
FIG. 2 is the sectional elevation of the system along line 1—1 of FIG. 1.

As depicted in FIG. 1, the light-weight paper or cloth towel dispensing system is easily made with plastic, metal or similar other material by integrating the basic subsystems consisting of the cabinet 72, the lever 6, the central axle or shaft and the unidirectional gear system coupled to the shaft. The lever 6 along with the gears and the rebound spring system 14 (FIG. 3), are located toward one end of the cabinet (FIG. 2) which provides a unified and clean appearance. All these components of the system are mounted on the central axle of the cabinet, that is, the shaft (FIG. 2). This shaft of the paper roller extends to act also as the axle for the outer driver-gear 7 and the inner toothed-gear 17 (FIG. 4).

Figure 3:
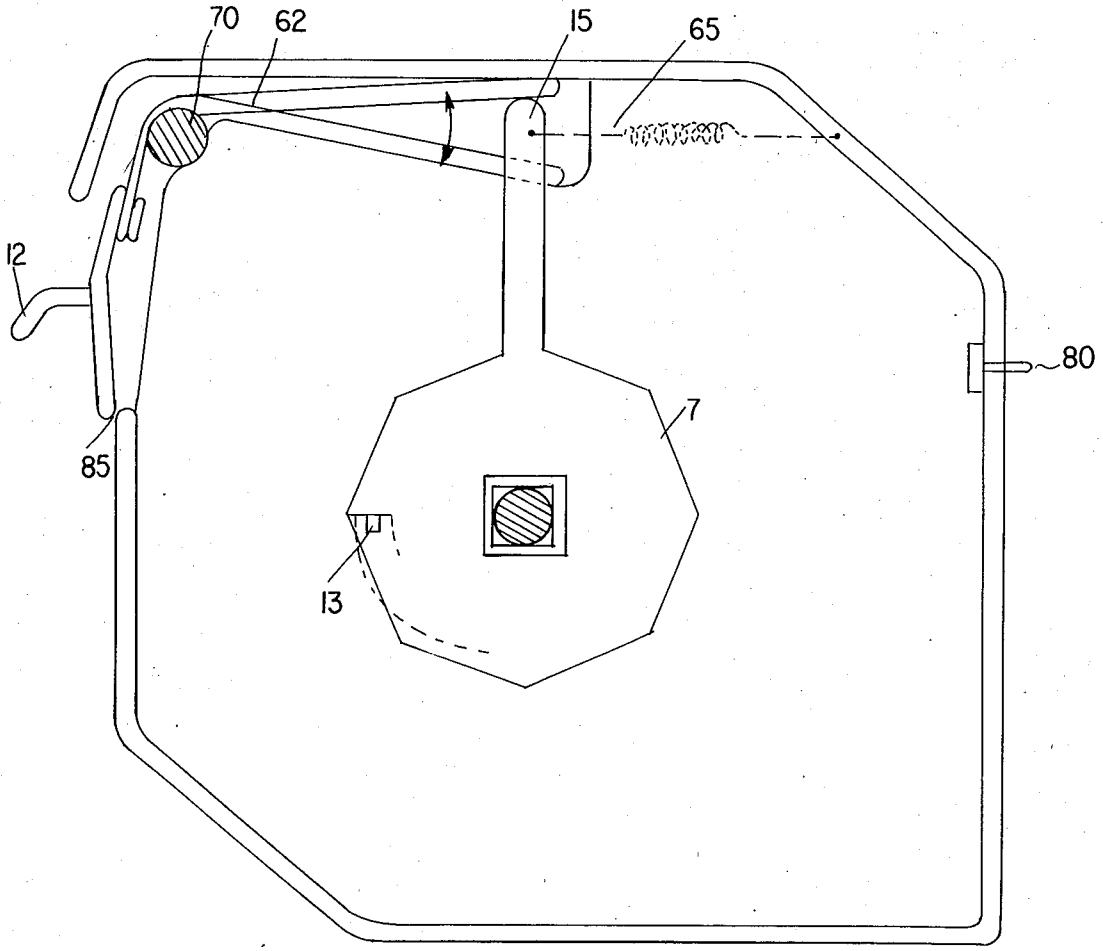
FIG. 3 is the sectional view along line 2—2 of FIG. 1.
Figure 4:
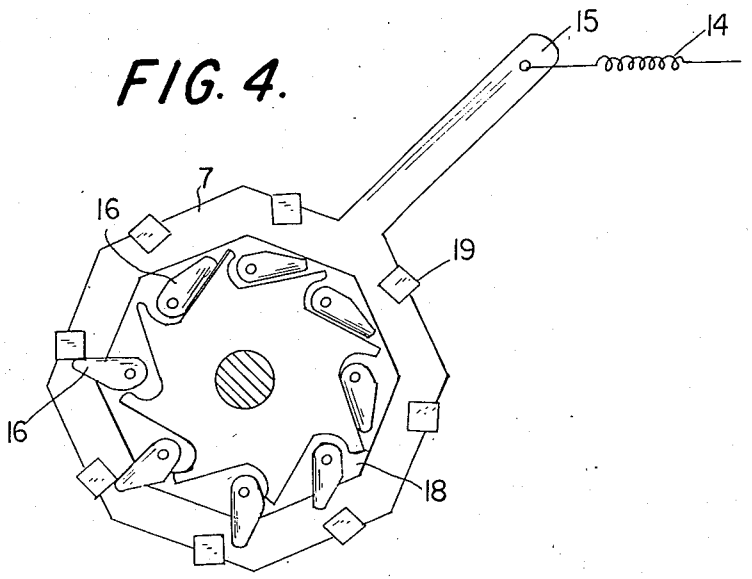
FIG. 4 shows the details of the unidirectional gear system.

The cabinet is bolted to the wall or appropriate furniture depending on the usuage (FIG. 3). The back wall of the cabinet has two holes through which nails or screws 80 are inserted to mount the cabinet on a wall. The rebounce spring 14, as the name indicates, returns the locking lever 15 automatically back to its original position as depicted in FIG. 3.

The system works as described below.

Figure 7:
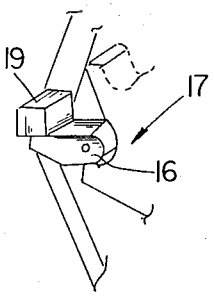
FIG. 7 provides the detailed view of a toothed-gear pin pushed down by a tooth of the drive-gear.
Figure 6:
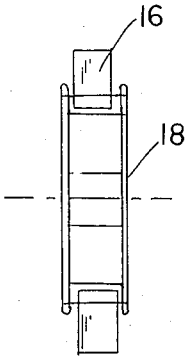
FIG. 6 shows the sectional elevation of the motherpiece toothed-gear.
Figure 5:
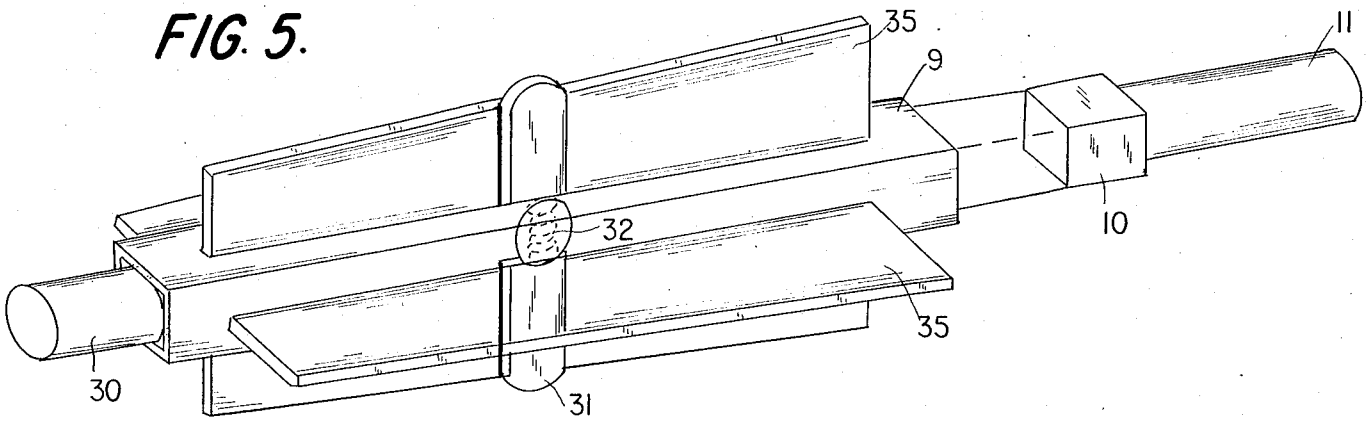
FIG. 5 provides the details of the towel roller axle or shaft system.

The inner toothed-gear (motherpiece) 17 has eight pins 16 mounted on their axles to rotate clockwise but prevented to rotate counter-clockwise by the teeth 20 of the motherpiece 17 on which these pins 16 are mounted. The axles of the pins are supported on two thin plates 18 attached onto the two sides of the motherpiece 17 (FIG. 6). The position of a pin at any time is dictated by gravity. When the user pushes the lever 6 downwards, the driver-gear tooth 19 closest to a suspended pin 16 out of the motherpiece socket, pushes such a pin in the direction of the movement of the lever, that is, in the counter-clockwise direction (FIG. 7). This rotational movement of the inner toothed-gear 17 rotates the axle of the paper roller 30 connected to the toothed-gear 17 via a square end-piece 10 as shown in FIG. 5. The roller 30 is thereby rotated in the direction of the towel web release, that is, in the forward direction, unwinding the web over the lip 5 of the cabinet (FIG. 1).

The lip release mechanism works this way. As soon as the lever 6 is pushed downwards by the user, the locking lever 15 turns counter-clockwise with the driver-gear 7 therby letting the counter-weight plate 62 drop as far as the slanted cut in the separater plate 65 will let it go (FIG. 3). The lip plate 5, connected to the counter-weight plate 62 over the top freely rotating axle 70, therefore moves out—away from the cabinet front—thereby widening the slit for the towel web to roll out (FIG. 3).

As soon as the lever 6 is released by the user, it is thrust back by the pull of the rebounce-spring 14. This does not affect the inner toothed-gear 17 as its pins 16 are thrown back into their respective cavities or recesses by the teeth 19 of the outer driver-gear 7 which now has no effect on the inner gear 17 (FIG. 3). Since the inner gear 17 is connected to the axle of the roller 30, it does not move at all in return movement of the outer gear 7. The locking lever 15 of the driver-gear 7, while being pulled back by the rebounce-spring 14, also pushes the counter-weight plate 62 upwards against the ceiling of the cabinet 72 (FIG. 3). The outer, front end of this counter weight plate is the lip 5. In the pushed back position of the locking lever 62, the counter weight plate is up and its front end lip 5 shuts against the opening 85 of the cabinet. Repeated pushes on the lever 6 repeats this action thereby releasing more towel web when the lever is pushed down and tightly grasping the width of the web in the cabinet opening when the lever is released. The user then holding the unrolled length of the web will tear it off as and when the released length is determined to be adequate for the user. The superiority of this system over the conventional towel dispenser is established by the fact that the user can release the paper or cloth towel by the gentle push of a lever.

The axle on which the towel roll is mounted consists of a hollow square tube 9 with a round solid tubular end 30 at one end and four webs 35 mounted on its four flat faces (FIG. 5). The other hollow square end of the axle fits onto the square butt end 10 of the solid cylindrical axle 11 of the inner toothed gear (FIG. 5). Two small plates 31 are mounted on a small central spring 32 at the mid-point of the towel roll axle to jut against the inner cylindrical surface of the towel roll and secure its placement on the axle.

Having thus described the invention, I claim:

1. A dispenser for dispensing a web from a roll of material comprising: a housing having a dispensing outlet, a roll of web material rotatably supported in the housing by a shaft, said shaft having at one end a first toothed gear, said gear comprising a central body attached to said shaft, said central body having a plurality of recesses about its outer periphery, said first gear further comprising a plurality of teeth pivotally mounted in each of said recesses, each of said recesses having an end wall limiting movement of said teeth in one direction, said teeth being mounted in said recesses such that said teeth have a retracted position wherein they are held in said recesses and an extended position in which said end wall limits movement of said teeth in said one direction, said dispenser further including a second gear, said second gear having means to contact said teeth of said first gear when said teeth are in said extended position, said second gear driving said first gear when said means contact said teeth to rotate said shaft to thus dispense said web of material through said dispensing outlet.

2. The dispenser of claim 1 wherein said second gear has an extended arm; a spring connecting said arm to a back wall of said dispenser housing; a freely rotating axle mounted in said housing; a bent plate suspended over said freely rotating axle; one end of the said bent plate held against a top wall of said dispenser housing by said arm, an opposite end of said plate held against said dispensing outlet of said housing when the said arm of said second gear is in a released position; when said arm is moved forward toward the front of said dispenser housing by the movement of a lever connected to said arm, said one end of said bent plate drops into a notch in a vertical partitioning plate thereby moving said opposite end of said bent plate away from said dispensing outlet and allowing said web material to freely descend through said dispensing outlet; said partitioning plate separating said roll of web from the said first and said second gears, said web material being caught in said dispensing outlet when said lever is released thereby allowing said arm of said second gear to move back to said released position to hold said one end of said bent plate against said top wall of said dispenser housing.

* * * * *